US007644646B1

(12) United States Patent
Peterson

(10) Patent No.: US 7,644,646 B1
(45) Date of Patent: Jan. 12, 2010

(54) THREE POSITION SERVO SYSTEM TO CONTROL THE DISPLACEMENT OF A HYDRAULIC MOTOR

(75) Inventor: Mark A. Peterson, Ames, IA (US)

(73) Assignee: Sauer-Danfoss, Inc., Ames, IA (US)

( * ) Notice: Subject to any disclaimer, the term of this patent is extended or adjusted under 35 U.S.C. 154(b) by 434 days.

(21) Appl. No.: 11/762,473

(22) Filed: Jun. 13, 2007

(51) Int. Cl.
*F15B 15/14* (2006.01)
*F15B 11/00* (2006.01)

(52) U.S. Cl. ..... 92/13.6; 91/422

(58) Field of Classification Search ..... 92/13.6, 92/13.8, 62, 131; 91/423, 422, 443, 449
See application file for complete search history.

(56) References Cited

U.S. PATENT DOCUMENTS

| | | | | |
|---|---|---|---|---|
| 2,831,464 | A * | 4/1958 | Lillquist | 92/13.1 |
| 3,667,225 | A | 6/1972 | Karman | |
| 3,732,785 | A * | 5/1973 | Boydell | 91/506 |
| 3,736,753 | A | 6/1973 | Roth | |
| 3,941,513 | A | 3/1976 | Malott | |
| 3,945,764 | A | 3/1976 | Marietta | |
| 3,958,493 | A * | 5/1976 | Fujita et al. | 92/13.6 |
| 4,342,256 | A | 8/1982 | Andersen et al. | |
| 4,530,371 | A | 7/1985 | Arav | |
| 5,056,600 | A | 10/1991 | Surjaatmadja et al. | |
| 5,101,942 | A | 4/1992 | Pruss et al. | |
| 5,520,217 | A | 5/1996 | Grawunde | |
| 5,836,160 | A | 11/1998 | Chang | |
| 5,928,099 | A | 7/1999 | Tsuemi et al. | |
| 5,992,460 | A | 11/1999 | Akimoto | |
| 6,248,037 | B1 | 6/2001 | Forster | |
| 6,343,537 | B1 * | 2/2002 | Iida et al. | 92/13.6 |
| 6,408,740 | B1 * | 6/2002 | Holt et al. | 92/13.6 |
| 6,443,706 | B1 | 9/2002 | Deininger et al. | |
| 6,481,333 | B1 | 11/2002 | Akasaka et al. | |
| 6,524,206 | B2 | 2/2003 | Tsuemi et al. | |
| 6,543,481 | B2 | 4/2003 | Neff et al. | |
| 6,688,417 | B2 | 2/2004 | Hansell | |
| 6,807,895 | B2 * | 10/2004 | Hirano et al. | 92/13.6 |
| 6,849,028 | B2 | 2/2005 | Nakatani et al. | |
| 7,008,343 | B2 | 3/2006 | Nagasugi et al. | |
| 7,047,993 | B2 | 5/2006 | Manaka et al. | |

FOREIGN PATENT DOCUMENTS

| | | |
|---|---|---|
| JP | 55002883 | 1/1980 |
| JP | 59077086 | 5/1984 |
| JP | 3078573 | 4/1991 |
| JP | 05223053 | 8/1993 |
| JP | 2001179450 | 6/2000 |

* cited by examiner

*Primary Examiner*—Thomas E Lazo

(57) ABSTRACT

A three position servo system. The servo system has a servo housing that has first and second control ports disposed therein in a cavity in fluid communication with the first and second control ports. A servo piston having at least one pressure chamber disposed therein is then used to communicate the pressure within the first and second ports into the first end of the cavity. Thus, when pressure is applied below a threshold pressure to both ports a first position is achieved, when pressure is applied above the threshold pressure in only one port a second position is achieved, and when pressure is applied above the threshold pressure in both ports a third position is achieved. Therefore, the servo system provides three different operating positions.

13 Claims, 4 Drawing Sheets

THREE POSITION SERVO SYSTEM TO CONTROL THE DISPLACEMENT OF A HYDRAULIC MOTOR

BACKGROUND OF THE INVENTION

This invention relates to a hydraulic unit. More specifically, this invention relates to a three position servo system that controls the displacement of a hydraulic motor.

Many types of mobile equipment use a two displacement hydraulic motor resulting in two distinct vehicle speed ranges. As the upper speed goals of these machines increase as part of periodic machine redesign projects, there becomes a larger and larger gap between the high and low speed ranges. Thus, a need for an intermediate speed range is desired.

Additionally, there are certain considerations that need to be taken into account if additional distinct speed ranges are to be added. Specifically, dual path machines (such as crawlers or skid steer loaders) will require a high degree of accuracy in any type of intermediate position in order to avoid mistracking problems.

Therefore, a principal object of the present invention is to provide a three position servo system to control the displacement of a hydraulic motor.

Yet another object of the present invention is to provide a multiple position servo system that provides optimal accuracy.

These and other objects, features or advantages of the present invention will become apparent from the specification and claims.

BRIEF SUMMARY OF THE INVENTION

A three position servo system having a servo housing. The servo housing has first and second control ports disposed therein and a cavity that is in fluid communication with the first and second control ports. A servo piston is disposed within the cavity for reciprocation therein and has at least one pressure chamber that provides fluid communication between the first control port and the cavity. Specifically, the servo system has a first position wherein pressure is provided below a threshold pressure in both the first and second control ports, a second position wherein pressure is provided above the threshold pressure at the first control port and pressure below the threshold pressure is supplied to the second control port, and a third position wherein pressure is above the threshold pressure supplied in both the first and second control ports. Thus, depending on the pressure provided within the first and second control ports of the servo housing three different positions are provided in the servo system.

DETAILED DESCRIPTION OF THE PREFERRED EMBODIMENT

Figure 1:
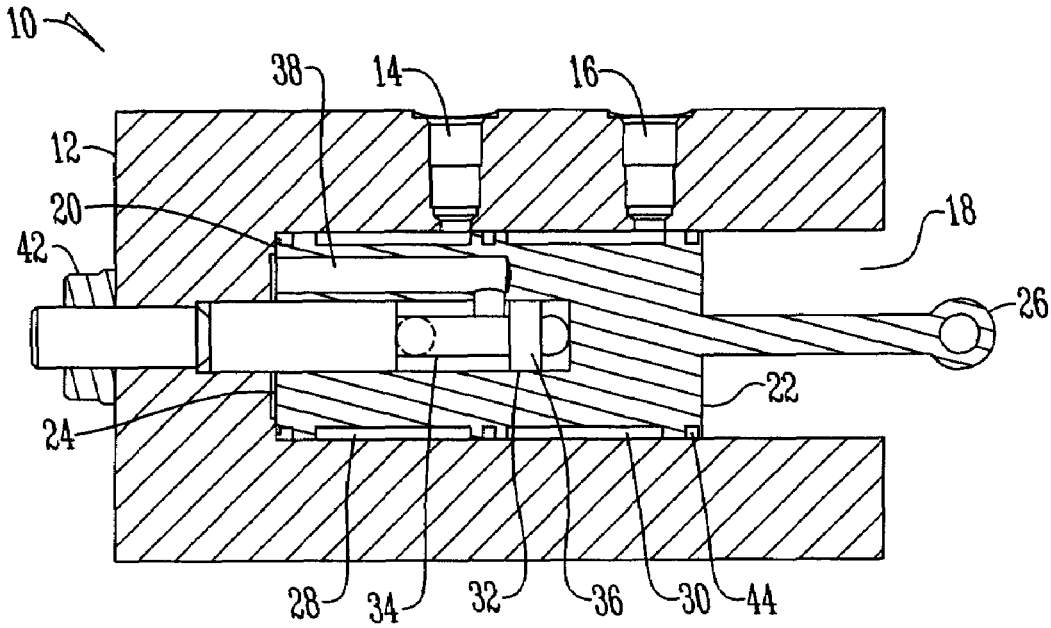
FIG. 1 is a sectional view of a three position servo system in a first position.
Figure 2:
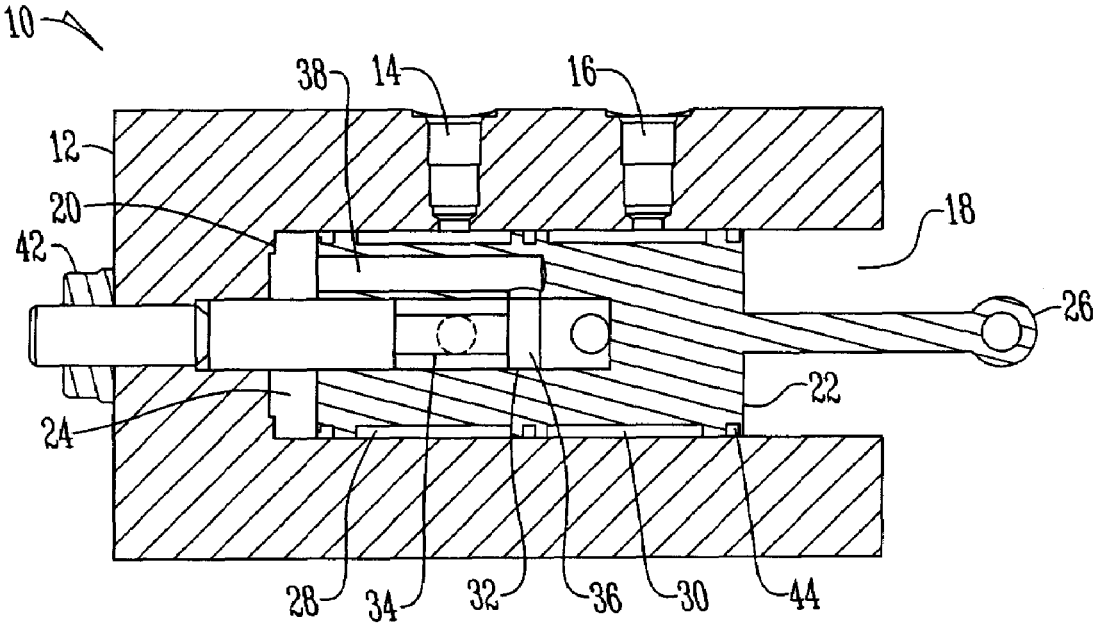
FIG. 2 is a sectional view of a three position servo system in a second position.
Figure 3:
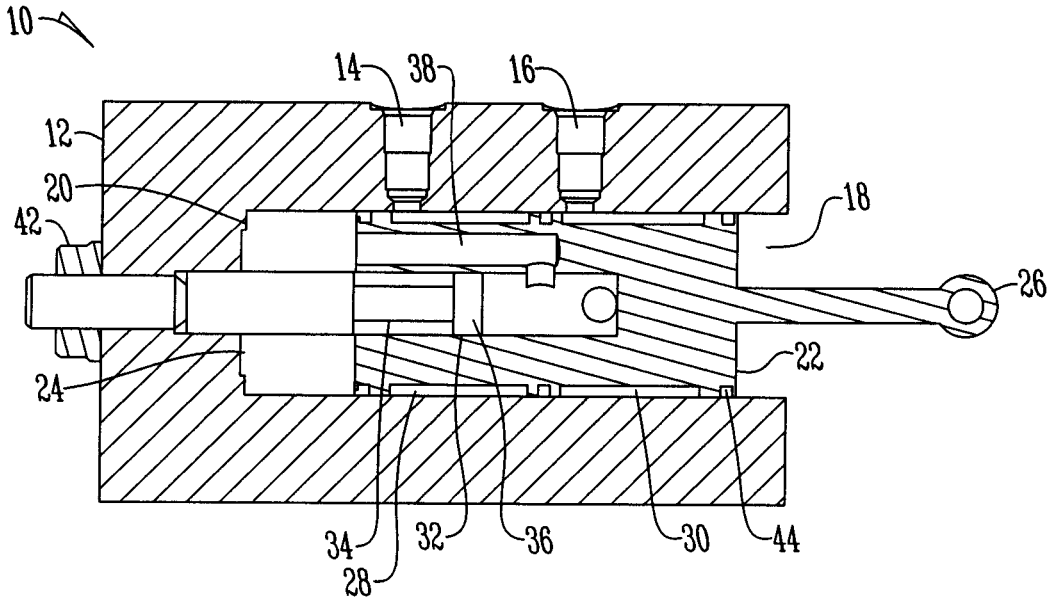
FIG. 3 is a sectional view of a three position servo system in a third position.

FIGS. 1-3 show a first embodiment of a three position servo system 10 having a servo housing 12. The servo housing 12 is shown as one piece; however, the housing could comprise an end cap as is known in the art. The servo housing 12 additionally has first and second control ports 14, 16 that are in fluid flow communication with a cavity 18 disposed through the servo housing 12. At a first end of the cavity 18 are mechanical stops 20 that function to stop the movement of a reciprocating servo piston 22 disposed within the cavity 18.

The reciprocating servo piston 22 extends from a first end 24 to a second end 26. The servo piston 22 at the second end 26 is attached to a swashplate (not shown) wherein the movement of the servo piston 22 is limited between the stops 20 and a second stop (not shown) adjacent the second end 26.

In the embodiment shown in FIGS. 1-3 the servo piston 22 has first and second pressure chambers 28, 30 that provide fluid communication between the first and second control ports 14, 16 and the first end of cavity 18 via the servo piston 22. Additionally disposed within servo piston is a bore 32 that receives a spool 34.

The spool 34 has a land 36 that aligns with a passageway 38 disposed within the servo piston 22 when the piston 22 is in a second position (FIG. 2) to provide fluid communication between the bore 32 and the first end of cavity 18. Also, the spool 34 extends and is disposed through the servo housing 12 and is threadably received by a nut element 42 to control the longitudinal movement of the spool. Also, a plurality of seals 44 are disposed between the servo piston 22 and servo housing 12.

Figure 4:
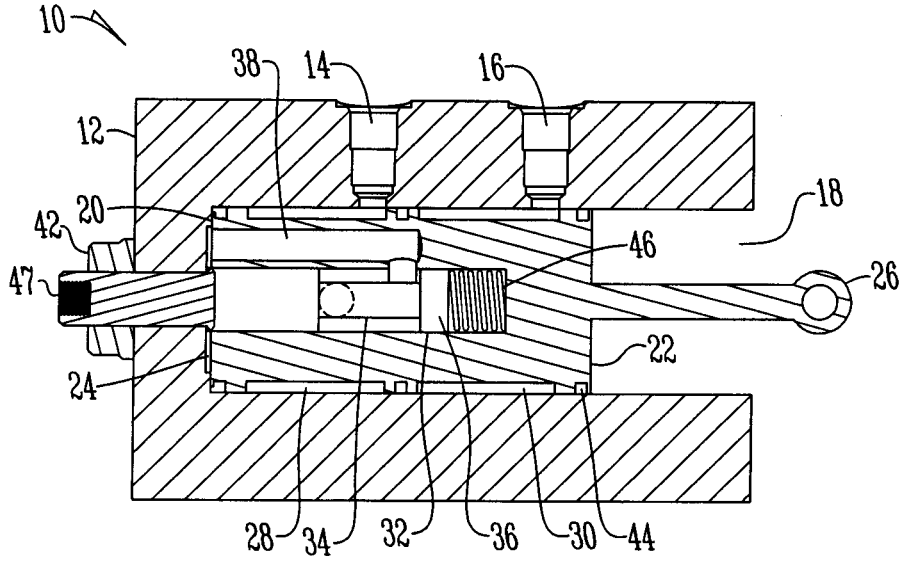
FIG. 4 is a sectional view of a three position servo system in a first position.
Figure 5:
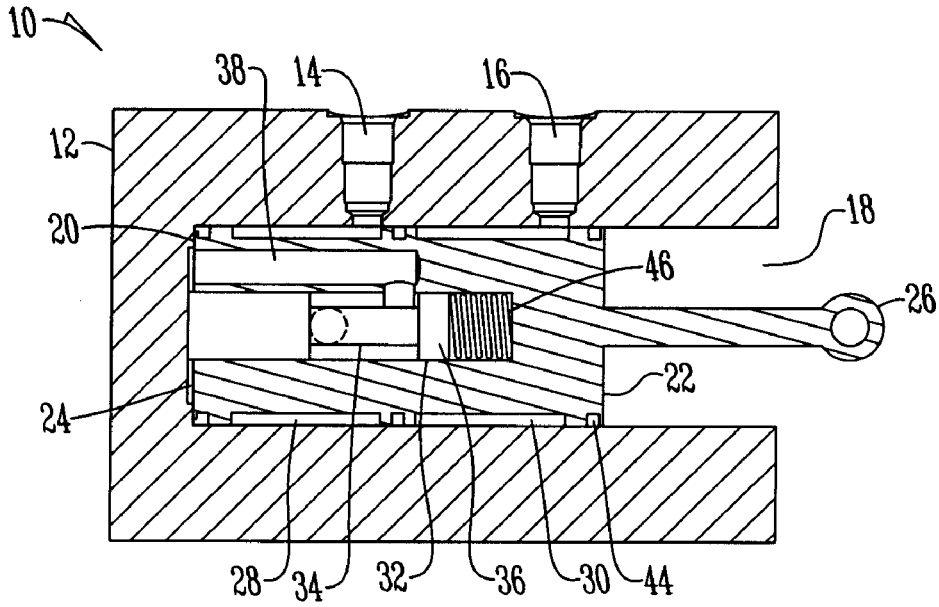
FIG. 5 is a sectional view of a three position servo system in a first position.

Though shown in a first embodiment (FIGS. 1-3) using a nut element to adjust the spool 34 in combination with first and second pressure chambers 28, 30 and a passageway 38 disposed within the servo piston 22, other options exist to provide the three position functioning. Specifically, in an alternative embodiment a spring element 46 may be disposed within the bore 32 of the servo piston 22 to bias the spool 34 away from the piston 22. (See FIGS. 4-5). In this embodiment, as shown in FIG. 4, an adjustment screw 47 is optionally added to adjust the longitudinal movement of the spool 34.

Figure 6:
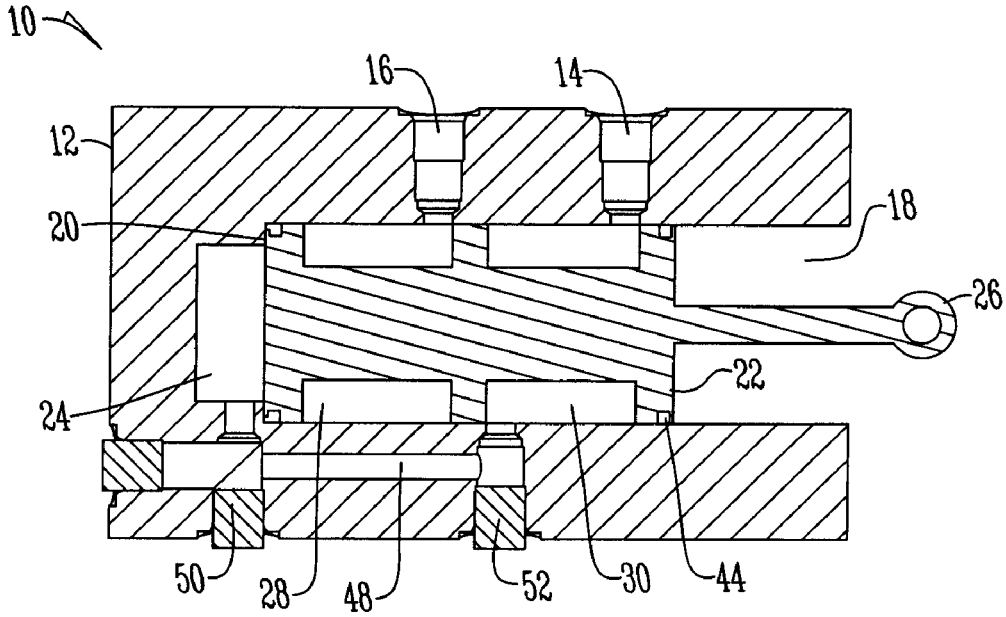
FIG. 6 is a sectional view of a three position servo system in a first position.

In another embodiment, instead of having a bore 32 that is used in combination with spool 34 and passageway 38 a housing passageway 48 may be used in combination with third and fourth control ports 50, 52. In this embodiment the third control port 50 is adjacent the first end of the cavity 18. (See FIG. 6).

Figure 7:
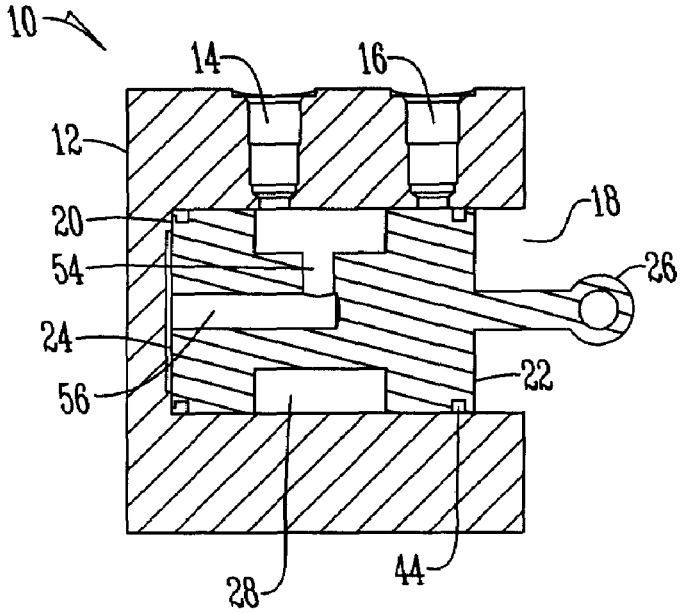
FIG. 7 is a sectional view of a three position servo system in a first position.
Figure 8:
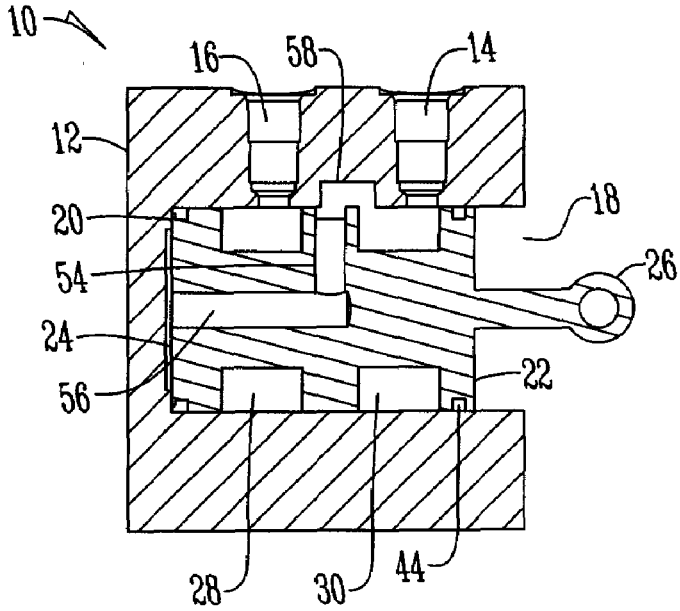
FIG. 8 is a sectional view of a three position servo system in a first position.

In yet another embodiment as shown in FIG. 7 there is only a single pressure chamber 28 disposed within the servo piston 22 wherein a transverse passageway 54 intersects a piston passageway 56 to provide fluid flow communication between the pressure chamber 28 and the first end of cavity 18. FIG. 8 shows an additional variation of the embodiment of FIG. 8 wherein the transverse and piston passageway 54, 56 are again used. In this embodiment the passageways 54, 56 are used in combination with the first and second pressure chambers 28, 30. Specifically, there is a groove 58 that is disposed within the housing 12 offset from and between the first and second passageways 28 and 30. Consequently, this arrangement provides fluid communication between the second pressure chamber 30 and the transverse passageway 54 in a first position, prevents fluid communication between the first and second pressure chambers 28, 30 and the transverse passageway 54 in a second position and allows fluid flow communication between the first pressure chamber 28 and the transverse passageway 54 in a third position.

As described in regards to all of the embodiments described, the servo piston 22 can be placed in three separate positions depending upon the pressurization of the first and second control ports 14, 16. Specifically, in a first position pressure is applied below a threshold pressure to the first and second control ports 14 and 16 causing the piston 22 to engage the stops 20 as shown in FIG. 1. Then, in a second position as shown in FIG. 2, pressure is applied to the first control port 14 above the threshold pressure while pressure is applied to the second control port 16 below the threshold pressure such that the servo piston 22 is maintained at an intermediary position. Then in a third position pressure is applied to the first and second control ports 14, 16 above the threshold pressure such that the piston 22 moves at its greatest distance away from the stops 20 of the cavity 18 wherein stops (not shown) adjacent the second end 26 of the piston 22 control this displacement. Hence, each embodiment provides for a three position servo system 10 that allows movement of the servo piston 22 in three separate distinct positions.

In alternative embodiments the spring element 46 applies a bias spring force to the servo piston itself and in another embodiment the spring applies pressure to the servo or swash-plate mechanism which is operated by the servo piston and pushes the servo piston fully in one direction when there is no control pressure applied to the servo. (both ports below the threshold pressure). The control spool 34 acts by porting fluid to one end of the servo piston 22 from one of two different pressure chambers 28, 30 within the servo piston 22. These two chambers 28, 30 are connected to the first and second control ports 14, 16 in the motor housing 12 or end cap by a system of seals 44 on the outside of the servo piston 22.

The resulting position of the servo piston 22 is the result of applying a control pressure to neither, one, or both of the control ports 14, 16. To achieve full extension of the servo piston 22, pressure is applied to both ports 14, 16 so that applied pressure is ported to the end of the servo piston 22 regardless of its position and the servo piston is extended against the servo spring until the piston 22 reaches its fully extended mechanical stop (not shown) adjacent the second end 26 of piston 22. To achieve full retraction of the servo piston 22, both control ports 14, 16 are connected to a low pressure reference so that this low pressure reference is connected to the end of the servo piston 22 regardless of its position and the servo spring 46 can push the servo piston against its fully retracted mechanical stop (not shown).

To achieve the intermediate position, pressure is applied to one of the control ports 14, 16 and the other is connected to a low pressure reference. Then a valve land 36 on the valve spool 34 acts in conjunction with a passageway 38 leading to the end of the servo piston 22 metering high or low pressure to the servo piston as needed to maintain the desired intermediate position. The spool land 36 therefore acts as a fixed reference point about which the servo piston is controlled in a hydraulic closed loop manner. Because the control spool position is screw adjustable the intermediate position is adjusted to meet the needs of the machine or to match the displacement or resulting speed of multiple motors used on the same machine.

Thus disclosed is a three position servo system that uses a control spool 34 and two control ports 14, 16 integrated into the servo piston 22. A fixed reference position of the control spool 34 results in an intermediate servo system position which has closed loop feedback control. Thus, at the very least all of the stated objectives have been met.

It will be appreciated by those skilled in the art that other various modifications could be made to the device without the parting from the spirit in scope of this invention. All such modifications and changes fall within the scope of the claims and are intended to be covered thereby.

What is claimed is:

1. A three position servo system comprising:

a servo housing having first and second control ports disposed therein and a cavity in fluid communication with the first and second control ports;

a servo piston disposed within the cavity of the servo housing for reciprocation therein and having at least one pressure chamber to provide fluid communication between the first port and the cavity;

wherein in a first position pressure below a threshold pressure is applied to the first and second control ports;

in a second position pressure above the threshold pressure is applied to the first control port while pressure below the threshold pressure is supplied to the second control port; and in a third position pressure above the threshold pressure is supplied to the first and second control ports.

2. The servo system of claim 1 wherein the servo piston has a passageway therein to provide fluid communication between a bore within the servo piston and the cavity of the housing.

3. The servo system of claim 2 wherein a spool is disposed with in the bore.

4. The servo system of claim 3 wherein an adjustment screw engages the spool.

5. The servo system of claim 4 wherein the adjustment screw has threads integral to the spool.

6. The servo system of claim 3 wherein in the second position the spool is aligned to provide the fluid flow communication between the bore of the servo piston and the cavity of the servo housing via the passageway.

7. The servo system of claim 3 wherein a spring is disposed within the bore of the servo piston to bias against the spool.

8. The servo system of claim 1 further comprising third and fourth control ports disposed within the housing and having a housing passageway disposed within the servo housing between the third and fourth control ports to provide fluid flow communication therebetween.

9. The servo system of claim 8 wherein the third port is adjacent a first end of the cavity of the housing.

10. The servo system of claim 1 wherein the servo piston has a single pressure chamber that is in fluid flow communication with a transverse passageway that is in fluid communication with a piston passageway to provide fluid flow communication between the single pressure chamber and the cavity.

11. The servo system of claim 1 wherein the servo housing has a groove disposed therein between the first and second control ports and wherein the servo piston has first and second pressure chambers.

12. The servo system of claim 11 wherein the piston has a transverse passageway and a piston passageway that provide fluid flow communication between the groove and the cavity.

13. The servo system of claim 12 wherein in the first position the groove is in fluid flow communication with the second control port; in the second position the groove is not in fluid flow communication with either the first or second control ports; and in the third position the groove is in fluid flow communication with the first control port.

* * * * *